US008585513B2

(12) United States Patent
Ban

(10) Patent No.: US 8,585,513 B2
(45) Date of Patent: Nov. 19, 2013

(54) GOLF CLUB HEAD AND METHOD OF MANUFACTURING THE SAME

(75) Inventor: Wataru Ban, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 373 days.

(21) Appl. No.: 12/969,088

(22) Filed: Dec. 15, 2010

(65) Prior Publication Data

US 2011/0151998 A1 Jun. 23, 2011

(30) Foreign Application Priority Data

Dec. 18, 2009 (JP) ..... 2009-287880

(51) Int. Cl.
*A63B 53/04* (2006.01)

(52) U.S. Cl.
USPC ..... 473/331; 473/342

(58) Field of Classification Search
USPC ..... 473/324–350
See application file for complete search history.

(56) References Cited

U.S. PATENT DOCUMENTS

| | | | | |
|---|---|---|---|---|
| 4,529,203 | A * | 7/1985 | Ribaudo | 473/331 |
| 5,100,144 | A * | 3/1992 | Okumoto et al. | 473/331 |
| 5,207,427 | A * | 5/1993 | Saeki | 473/343 |
| 5,935,018 | A * | 8/1999 | Takeda | 473/324 |
| 5,967,903 | A * | 10/1999 | Cheng | 473/342 |
| 6,059,670 | A * | 5/2000 | Mogan | 473/342 |
| 6,638,179 | B2 * | 10/2003 | Yoshida | 473/324 |
| 7,594,862 | B2 * | 9/2009 | Gilbert | 473/330 |
| 7,695,377 | B2 | 4/2010 | Yamagishi et al. | |
| 7,771,288 | B2 * | 8/2010 | Gilbert et al. | 473/324 |
| 7,780,549 | B2 | 8/2010 | Park et al. | |
| 7,846,039 | B2 * | 12/2010 | Gilbert et al. | 473/331 |
| 7,927,230 | B2 * | 4/2011 | Solheim | 473/329 |
| 8,075,420 | B2 * | 12/2011 | Rick | 473/342 |
| 8,172,698 | B2 * | 5/2012 | Solheim | 473/329 |
| 8,172,699 | B2 * | 5/2012 | Nakamura | 473/330 |
| 2002/0025861 | A1 * | 2/2002 | Ezawa | 473/342 |
| 2009/0176597 | A1 | 7/2009 | Yamagishi et al. | |
| 2009/0291774 | A1 * | 11/2009 | Bennett | 473/332 |
| 2010/0113180 | A1 * | 5/2010 | Nakamura | 473/331 |
| 2011/0151998 | A1 * | 6/2011 | Ban | 473/331 |
| 2011/0151999 | A1 * | 6/2011 | Ban | 473/331 |
| 2012/0190477 | A1 * | 7/2012 | Nakamura | 473/331 |
| 2012/0264537 | A1 * | 10/2012 | Breier et al. | 473/331 |

FOREIGN PATENT DOCUMENTS

| | | | | |
|---|---|---|---|---|
| JP | 02116389 | A * | 5/1990 | A63B 53/04 |
| JP | 06114128 | A * | 4/1994 | A63B 53/04 |
| JP | 09206411 | A * | 8/1997 | A63B 53/04 |
| JP | 10-277185 | A | 10/1998 | |
| JP | 2000014839 | A * | 1/2000 | A63B 53/04 |
| JP | 2008-023178 | A | 2/2008 | |
| JP | 2010110425 | A * | 5/2010 | |
| JP | 2011125541 | A * | 6/2011 | |
| JP | 2011125542 | A * | 6/2011 | |

OTHER PUBLICATIONS

U.S. Office Action, dated Feb. 15, 2013, issued in co-pending U.S. Appl. No. 12/969,105.

* cited by examiner

*Primary Examiner* — Alvin Hunter
(74) *Attorney, Agent, or Firm* — Sughrue Mion, PLLC

(57) ABSTRACT

A golf club head according to this invention has scorelines formed in its face surface. A first plated layer is formed on at least the face surface of a head base body before the scorelines are formed in the face surface, the face surface is grooved to form the scorelines in it, and a second plated layer is formed on the face surface.

8 Claims, 2 Drawing Sheets

GOLF CLUB HEAD AND METHOD OF MANUFACTURING THE SAME

BACKGROUND OF THE INVENTION

1. Field of the Invention

The present invention relates to a golf club head and a method of manufacturing the same and, more particularly, to a golf club head suitable as an iron type golf club head and a method of manufacturing the same.

2. Description of the Related Art

An iron type golf club head has grooves called scorelines, which are formed in its face surface. It is often the case that a plated layer is formed on at least the face surface of the club head in order to, for example, increase the hardness of the face surface and improve its corrosion resistance and appearance.

In a conventional method of manufacturing an iron type golf club head coated with a plated layer, at least the face surface of a head base body before scorelines are formed in the face surface is grooved to form the scorelines in it and is plated.

Japanese Patent Laid-Open No. 2008-23178 describes a golf club head having cutting traces formed in its face surface by milling the face surface (by cutting it using a milling machine).

As in the method described in Japanese Patent Laid-Open No. 10-277185, when the face surface of a head base body is grooved to form scorelines in it and is plated, the accuracy of the edges of the scorelines, on which their groove side surfaces and the face surface intersect with each other, deteriorates. That is, when the face surface of a head base body is grooved to form scorelines in it, the edges of the scorelines, on which their groove side surfaces and the face surface intersect with each other, have an ideal edge shape, but the edge accuracy deteriorates upon forming a plated layer on the face surface in order to, for example, improve its durability, because the plated layer has a certain thickness.

SUMMARY OF THE INVENTION

The present invention has been made in order to solve the above-mentioned problem, and has as its object to provide a golf club head in which a plated layer is formed in its face surface and which has a high accuracy of the edges of scorelines, on which their groove side surfaces and the face surface intersect with each other, and a method of manufacturing the same.

According to an aspect of the present invention, there is provided a golf club head having scorelines formed in a face surface thereof, wherein a first plated layer is formed on at least the face surface of a head base body before the scorelines are formed in the face surface, the face surface is grooved to form the scorelines therein, and a second plated layer is formed on the face surface.

Further features of the present invention will become apparent from the following description of exemplary embodiments with reference to the attached drawings.

DESCRIPTION OF THE EMBODIMENTS

Figure 1:
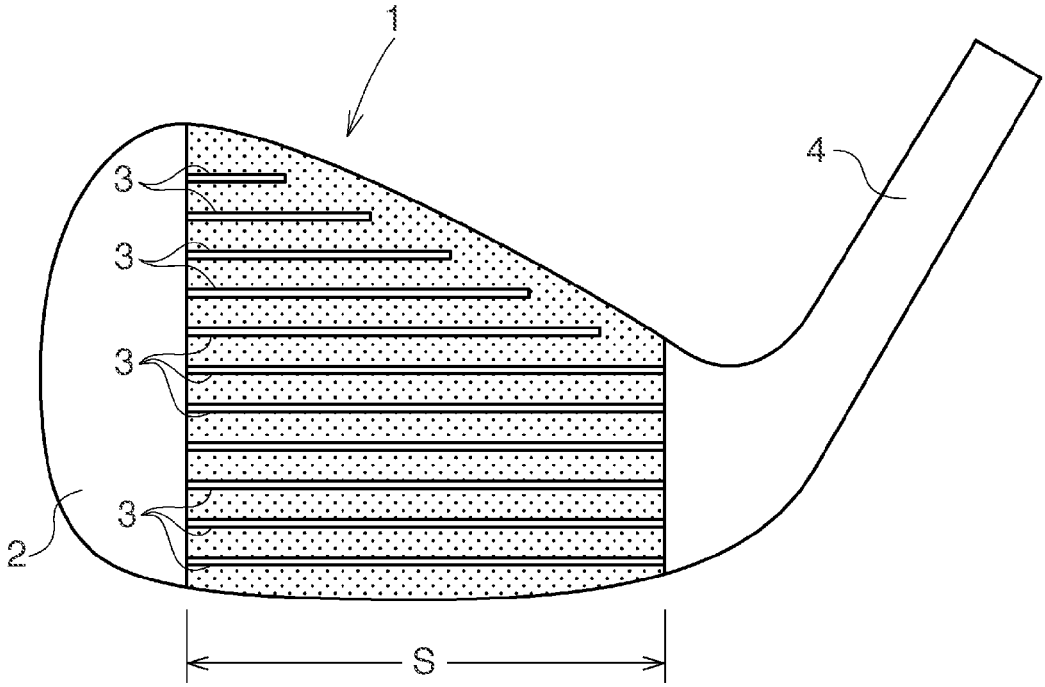
FIG. 1 is a front view of an iron type golf club head according to an embodiment of the present invention.

FIG. 1 is a front view of a golf club head 1 having a large number of scorelines 3 formed in a face surface 2. A golf club is formed by inserting a shaft into a hosel portion 4 provided on the golf club head 1, and fixing it in position using an adhesive.

Figure 2A:
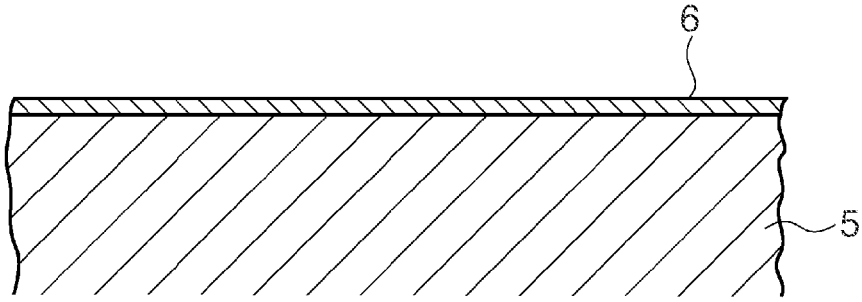
FIGS. 2A to 2C are sectional views of the face surface, which show a method of forming scorelines in it.
Figure 2B:
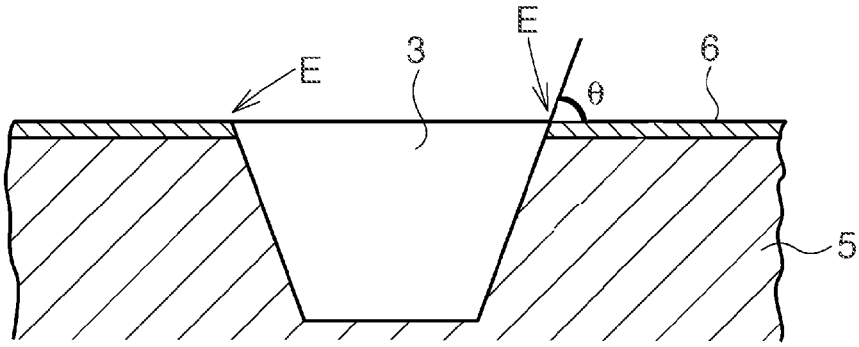
Figure 2C:
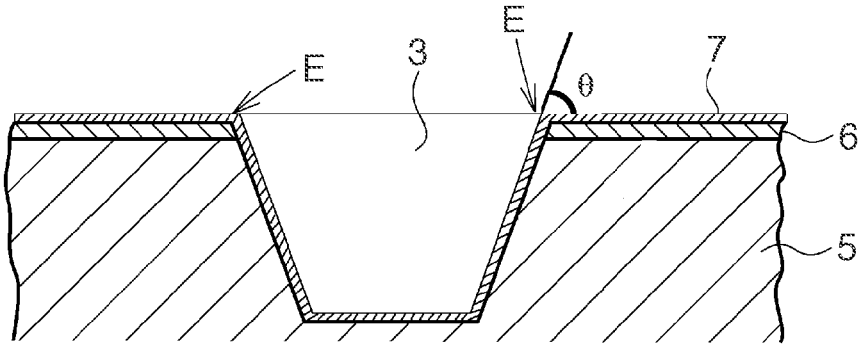

As shown in FIGS. 2A to 2C, the golf club head 1 is manufactured by forming a first plated layer 6 on at least the face surface 2 of a head base body 5 made of an iron-based material or a metal material such as aluminum or titanium, grooving the face surface 2 to form the scorelines 3 in it, and forming a second plated layer 7 with a hardness lower than the first plated layer 6 on the face surface 2. The head base body 5 is a primary molded product before the plated layers 6 and 7 and the scorelines 3 are formed on and in the face surface 2.

The scorelines 3 preferably have an open-side groove width of 0.6 to 0.9 mm and a depth of 0.2 to 0.5 mm. Although the scorelines 3 have a trapezoidal cross-section and have an angle θ of about 45° to 80° that the face surface makes with their groove side surfaces in this embodiment, they may be right-angled grooves with an angle θ=90°. Also, the scorelines 3 may have a roughly U-shaped or roughly semielliptical cross-section.

The first plated layer 6 preferably includes one or two or more layers plated with, for example, chromium, nickel, or hard chromium, and preferably has a thickness (an overall thickness if it includes a plurality of layers) of 5 to 60 μm, and especially, about 15 to 50 μm. The first plated layer 6 preferably has a hardness of 500 to 1,200 Hv, and especially, about 800 to 1,000 Hv.

The second plated layer 7 preferably includes one or two or more layers plated with copper, alumite, or zinc, and preferably has a thickness (an overall thickness if it includes a plurality of layers) of 5 to 60 μm, and especially, about 15 to 50 μm. The second plated layer 7 preferably has a hardness of 100 to 450 Hv, and especially, about 200 to 300 Hv. The thickness of the second plated layer 7 preferably is 90% or less and, for example, about 20 to 80% that of the first plated layer 6.

The first plated layer 6 and second plated layer 7 may be formed by either electroless plating or electrolytic plating. However, electroless plating is more preferable than electrolytic plating because in the former plated layers with uniform thicknesses can be more easily formed. Preferable examples of electroless plating include nickeline plating, nickel plating, and SIC composite plating.

A golf club head 1 as mentioned above is preferably manufactured by the following method.

First, a head base body 5 is manufactured by casting or forging. The head base body 5 has nearly the same shape and size with the golf club head 1, except that in the former scorelines 3 have not yet been formed in it.

Next, the face surface of the head base body 5 is preferably milled into a flat surface with a specific flatness. In this processing, the face surface is preferably cut by a cutting machine while the head base body 5 is fixed in position.

At least a face surface 2 of the head base body 5 is plated to form a first plated layer 6 on it. The first plated layer 6 may be provided only on the face surface 2 or provided not only on the face surface 2 but also in other portions. The first plated layer 6 may be provided on, for example, the entire surface of the head base body 5.

The face surface 2 is grooved to form scorelines 3 in it. The shape of a cutting tool (end mill) for grooving is not particularly limited, and may be, for example, a shape tapered at the same angle as the angle θ of the side surfaces of the scorelines 3 shown in FIG. 2B. Also, the cutting tool may have its lower half with a shape tapered at the same angle as the angle θ, and its upper half with a shape tapered at a slope larger than the lower half (that is, a shape in which the angle that the face surface 2 makes with the upper half side surfaces is smaller than the angle θ), so that the lower and upper halves are smoothly continuous with each other at their boundary portion. By grooving the face surface 2 using this cutting tool such that the boundary portion of the cutting tool is flush with the surface of the first plated layer 6, edges (to be also referred to as the edges of the scorelines hereinafter) E of the scorelines 3, on which their groove side surfaces and the face surface 2 intersect with each other, can be formed into a shape conforming to that boundary portion. In addition, the edges E may be burred as needed after the scorelines 3 are formed.

Lastly, a second plated layer 7 is formed. The second plated layer 7 may be provided only on the face surface 2 or provided not only on the face surface 2 but also in other portions. The second plated layer 7 may be provided on, for example, the entire surface of the head base body 5. After that, the face surface 2 is blasted as needed and frosted. Although the face surface 2 is preferably blasted only in a scoreline forming region S shown in FIG. 1 to visually indicate the player the ball hitting surface, the entire face surface 2 or the entire head may be blasted. With this processing, the friction coefficient of the face surface 2 is expected to increase. The second plated layer 7 is preferably blasted to a slight degree so as not to expose the first plated layer 6. Also, the second plated layer 7 is preferably blasted such that the blasted second plated layer 7 has a thickness that falls within the above-mentioned preferable range. Examples of the blasting include sandblasting and shot blasting.

The golf club head 1 is manufactured by the foregoing processes, but the above-mentioned blasting may be omitted. Also, a process of milling the head base body 5 may be added to the foregoing processes.

In the milling, the face surface is shallowly cut using, for example, a milling machine to form a large number of minute recessed streaks (grooves) in it. With this processing, the friction coefficient of the face surface increases, and this facilitates a back spin. The pitch of the cutting traces produced by the milling preferably is about 0.1 to 1 mm. Even if the milling takes place, the first plated layer 6 and second plated layer 7 formed on the face surface 2 preferably have the above-mentioned thicknesses. When the milling height is set to 25 μm that is the upper limit of a golf rule, the plated layers 6 and 7 preferably have a total thickness of 10 to 120 μm. The milling pattern may be formed by a laser.

Instead of milling the head base body 5 in the foregoing way, the face surface 2 may be milled after the first plated layer 6 and second plated layer 7 are formed on the head base body 5. In this case, the face surface 2 is preferably milled such that the grooves do not reach the head base body 5. This prevents the head base body 5 from being exposed and rusting. The face surface 2 may be milled such that the grooves reach or do not reach the first plated layer 6. A golf rule stipulates that the milling height (the depth of the streaks) must be 25 μm or less, so the plated layers 6 and 7 preferably have a total thickness of 25 μm or more, and especially, 28 μm or more.

Alternatively, the face surface 2 may be milled during the time after the first plated layer 6 is formed on the head base body 5 and before the second plated layer 7 is formed.

In the golf club head 1 according to this embodiment, the first plated layer 6 is formed on the face surface 2 of the head base body 5, the face surface 2 is grooved to form the scorelines 3 in it, and the thin second plated layer 7 with a low hardness is formed. In this case, the plated layer formed after the scorelines 3 are formed is thinner than that when both the first plated layer 6 and second plated layer 7 are formed after the scorelines 3 are formed. Thus, the edges E of the scorelines 3 are formed by grooving the face surface 2 with high precision, and are covered with the second plated layer 7, thereby preventing the shape of the edges E from changing to a considerable degree. As a result, the edges E of the scorelines 3 have a high accuracy.

The edges E of the above-mentioned scorelines may be angled edges or non-angled round edges. The round edges preferably have an effective radius of 0.05 mm to 0.3 m, and especially, 0.1 mm to 0.2 mm. Thus, the golf club head 1 becomes less likely to damage a golf ball, and allows the player to produce an appropriate back spin.

Also, because the second plated layer 7 with a low hardness is provided on the top surface, the golf club head 1 gives the player a soft impact feel. Because the second plated layer 7 is formed up to the scorelines 3, the head base body 5 is not exposed in the scorelines 3. This prevents the head base body 5 from rusting due to, for example, rainwater or agricultural chemicals sprayed onto the green. This also makes the face surface 2 and scorelines 3 have the same color tone, so the golf club head 1 becomes excellent in appearance.

When the face surface 2 of the head base body 5 is milled into a flat surface before the first plated layer 6 is formed, the surface accuracy of the face surface 2 becomes high.

The second plated layer 7 may be formed in a face surface portion (including the edges E of the scorelines 3) other than the scorelines 3 upon masking them.

Although the golf club head 1 is of the iron type in this embodiment, the present invention is also applicable to a hybrid golf club head having its face surface made of a metal material and its remaining part at least partially made of, for example, carbon, a synthetic resin, a fiber-reinforced synthetic resin, or ceramics.

In this embodiment, one or two or more second plated layers 7 may be provided, like the first plated layer 6. However, only one second plated layer 7 is preferably provided in order to obtain a high dimensional accuracy of the edges E of the scorelines 3.

Although only the plated layers 6 and 7 are formed on the head base body 5 in this embodiment, another layer may be formed in at least one of the region between the head base body 5 and the first plated layer 6, that between the first plated layer 6 and the second plated layer 7, and that on the upper surface of the second plated layer 7. For example, the surface of the head base body 5 may be carburized or nitrided to form a hard layer on it. Also, a layer such as a carbon layer (for example, a diamond-like carbon layer) may be formed in at least one of the region between the head base body 5 and the first plated layer 6, that between the first plated layer 6 and the second plated layer 7, and that on the upper surface of the second plated layer 7.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-287880, filed Dec. 18, 2009, which is hereby incorporated by reference herein in its entirety.

What is claimed is:

1. A golf club head having scorelines formed in a face surface thereof, wherein a first plated layer is formed on at least the face surface of a head base body before the scorelines are formed in the face surface, the face surface is grooved to form the scorelines therein, a second plated layer is formed on the face surface, and the face surface of the head base body is milled into a flat surface before the first plated layer is formed.

2. The head according to claim 1, wherein the second plated layer has a hardness lower than the first plated layer.

3. The head according to claim 1, wherein the second plated layer is thinner than the first plated layer.

4. The head according to claim 1, wherein the first plated layer includes a chromium-plated layer, and the second plated layer includes a copper-plated layer.

5. A method of manufacturing a golf club head having scorelines formed in a face surface thereof, said method comprising the steps of:

forming a first plated layer on at least the face surface of a head base body before the scorelines are formed in the face surface;

grooving the face surface, on which the first plated layer is formed, to form the scorelines therein; and forming a second plated layer on the face surface, wherein the face surface of the head base body is milled into a flat surface before the first plated layer is formed.

6. The method according to claim 5, wherein the second plated layer has a hardness lower than the first plated layer.

7. The method according to claim 5, wherein the second plated layer is thinner than the first plated layer.

8. The method according to claim 5, wherein the first plated layer includes a chromium-plated layer, and the second plated layer includes a copper-plated layer.

* * * * *